US006404407B1

(12) United States Patent
Chang

(10) Patent No.: US 6,404,407 B1
(45) Date of Patent: Jun. 11, 2002

(54) ANTENNA DETACHING-PROOF ROTATION IDLING DEVICE

(75) Inventor: Yu-Pin Chang, Pa-Te (TW)

(73) Assignee: Auden Techno Corp. (TW)

( * ) Notice: Subject to any disclaimer, the term of this patent is extended or adjusted under 35 U.S.C. 154(b) by 0 days.

(21) Appl. No.: 09/948,609

(22) Filed: Sep. 10, 2001

(51) Int. Cl.[7] ..... H01R 9/24
(52) U.S. Cl. ..... 343/906; 439/886
(58) Field of Search ..... 343/906, 702, 343/895; 439/886, 63, 887, 583, 70; 333/260

(56) References Cited

U.S. PATENT DOCUMENTS 5,796,323 A * 8/1998 Uchikoba et al. ..... 333/260
6,123,589 A * 9/2000 Andoh et al. ..... 439/886
6,219,007 B1 * 4/2001 Kline et al. ..... 343/895

* cited by examiner

*Primary Examiner*—Don Wong
*Assistant Examiner*—James Clinger
(74) *Attorney, Agent, or Firm*—Troxell Law Office PLLC

(57) ABSTRACT

An antenna detaching-proof rotation idling device having a metal connector with an electroplated inner bore to lock on an antenna-connecting seat of a mobile phone. The connector has its threaded section extended down from its main disk body. An insulating piece is mounted in the inner bore of the connector in a tight connecting mode. A central guiding needle is installed in a central bore in the insulating piece in a loose connecting mode. The top end of the needle gets above the disk body of the connector to mount an electric circuit board. The bottom of the needle is exposed a given length under the connector. The portion of the connector above the disk body is ejection shaped into a sleeve. The sleeve, the electric circuit board and the needle are connected and moved together. The connector being plated with a layer of white chrome, after the sleeve is mounted, it will be rotation idling when being rotated. Thus bad signal receiving and damage of the electric circuit board by users' random rotating can be prevented.

7 Claims, 5 Drawing Sheets

ANTENNA DETACHING-PROOF ROTATION IDLING DEVICE

BACKGROUND OF THE INVENTION

1. Field of the Invention

The invention is related to an antenna detaching-proof rotation idling device, and especially related to such a device suiting mobile phones for preventing detachment at will by a user after the antenna is assembled in the factory.

2. Description of the Prior Art

The antenna of a usual mobile phone mostly uses a helical coil as a main element for transmitting and receiving signals. Taking the fixed antenna of a mobile phone as an example, the helical coil and the metallic connecting seat at its lower position are installed in the interior of a plastic rod by any of various manufacturing procedures, then a rod like standing upright antenna is formed. Thus the antenna rod can be assembled on the top end of the mobile phone through a connecting section provided on its bottom.

After an antenna of a conventional combination structure is manufactured in the factory and handed over to a user, it is in a completely non-protected state. That is to say, a user can rotate at any time in a direction opposite to that along which the antenna is locked, and then the antenna will be detached from the antenna seat. Since a mobile phone is a communication instrument for taking with one at any time, it is very common to see the situation of detachment or loosening of this kind. of antenna by rotating in such an opposite direction, no matter the user is doing it for fun because of boring or doing it on purpose. But if the antenna assembled on the housing is detached and assembled frequently, a problem of bad receiving of signals will be induced to affect its receiving capacity quite large; it is even possible to burn down the electric circuit board if it is seriously affected.

SUMMARY OF THE INVENTION

The object of the present invention is to provide an antenna detaching-proof rotation idling device; after being locked on a mobile phone in the factory, the antenna will be in a rotational idle state if no tool is used but the antenna is rotated with hands. This can prevent possible damage to the mobile phone caused by frequent detachment and assembling of the antenna.

To achieve the above-mentioned object, the present invention has a metal guiding needle installed in the central bore of an insulating piece in a loose state. An electric circuit board can be welded to the top end of the guiding needle, and the lower portion of the guiding needle is exposed a given length. The insulating piece can be assembled into a connector in a tight connecting state; the connector can be connected with the antenna of a mobile phone with a tool. After the abovementioned elements are assembled, a sleeve of the antenna rod is connected with the electric circuit board during ejection shaping to render the central guiding needle to make idle rotating when the sleeve is rotated.

The present invention will be apparent in its novelty and other features after reading the detailed description of the preferred embodiment thereof in reference to the accompanying drawings.

DETAILED DESCRIPTION OF THE PREFERRED EMBODIMENT

Figure 1:
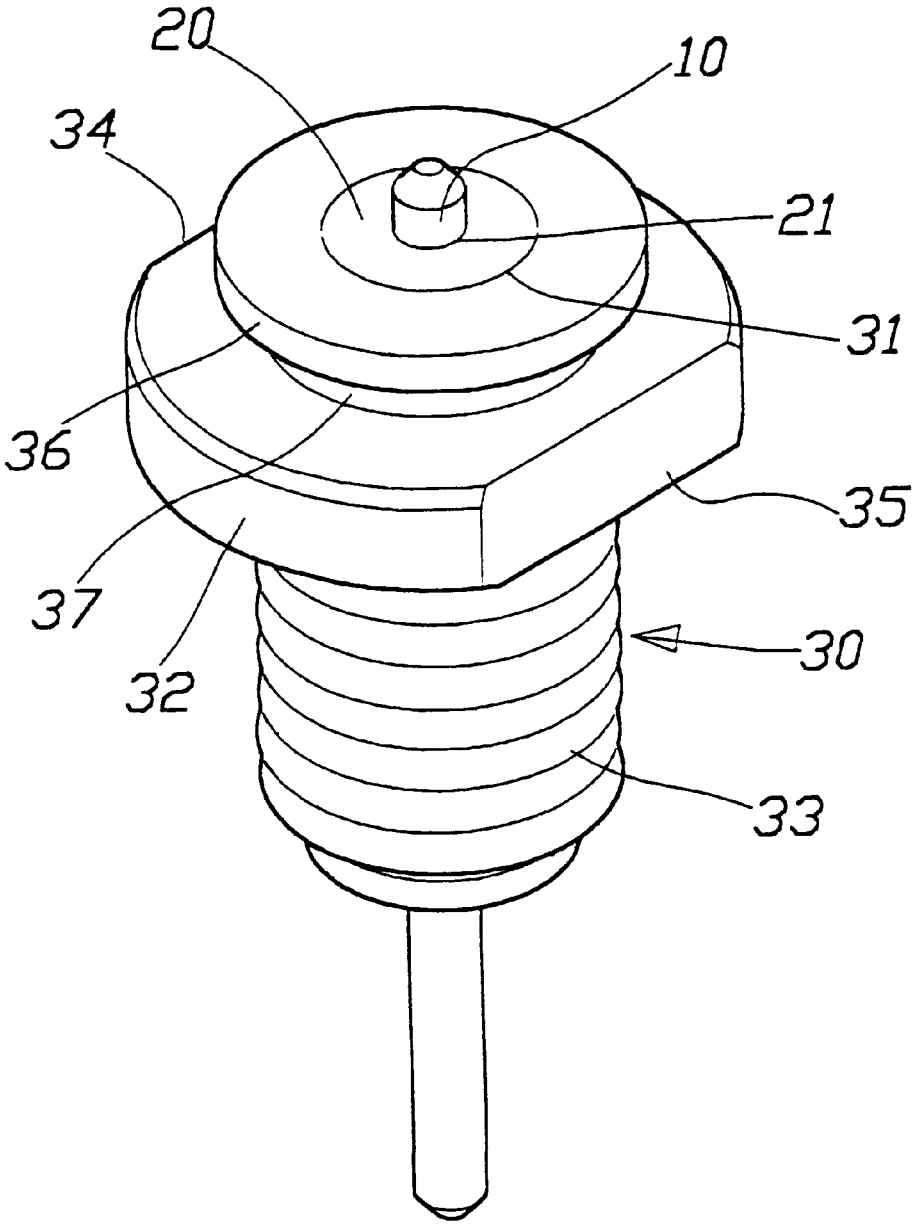
FIG. 1 is a perspective view of the preferred embodiment of the present invention.
Figure 2:
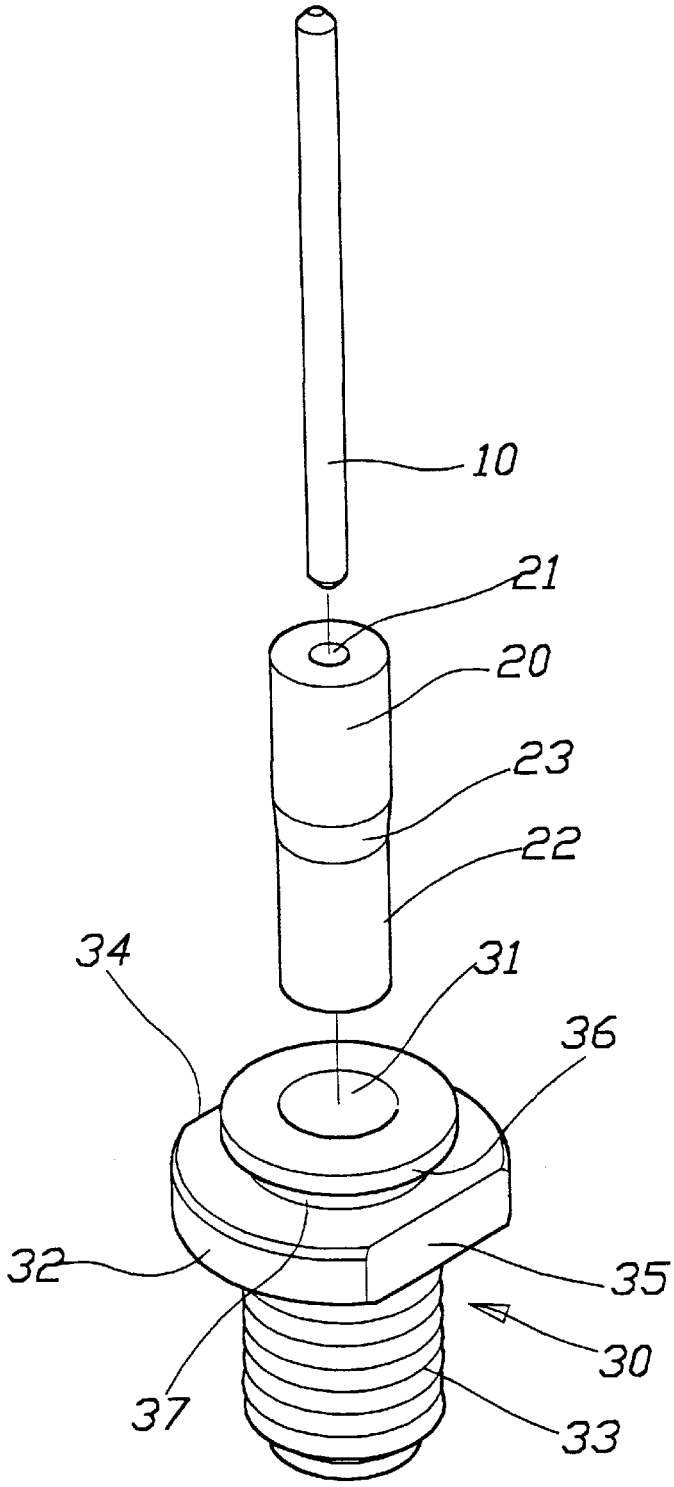
FIG. 2 is an analytical perspective view of the elements shown in FIG. 1
Figure 3:
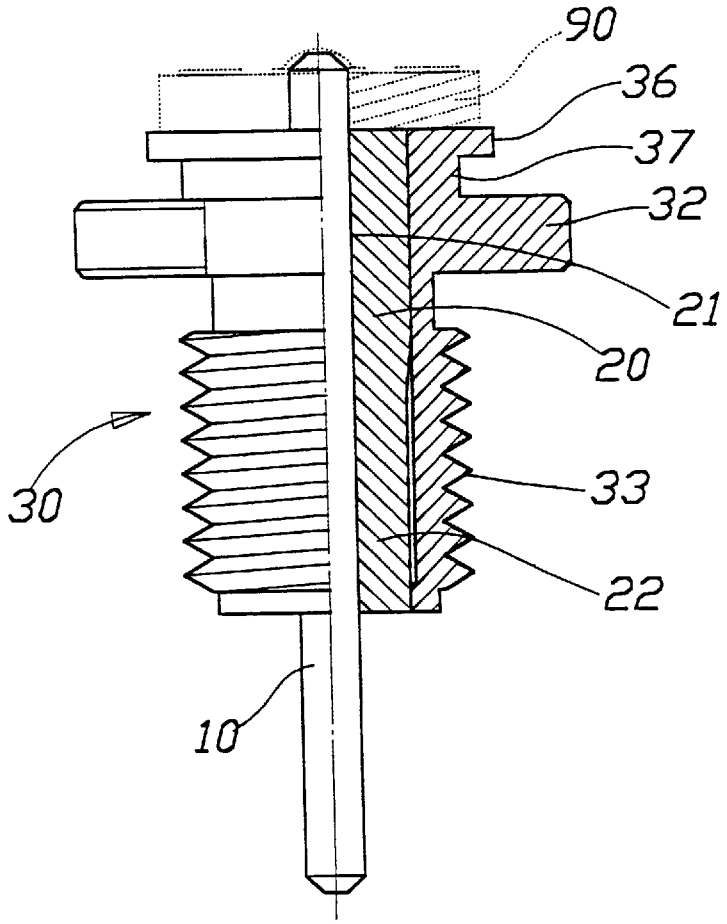
FIG. 3 is a sectional view from FIG. 1.

Referring to FIGS. 1–3, the present invention has a vertical central guiding needle 10 of proper size and length, the surface of the guiding needle 10 is preferably plated with nickel, and then is inserted and installed in a insulating piece 20 in a loose connecting mode. In order to have a proper loose connecting structure for the central guiding needle 10 and the insulating piece 20, the central guiding needle 10 had better have a negative tolerance in processing (e. g. the processing tolerance is from 0.00 mm to −0.01 mm), while the processing tolerance of the insulating piece 20 is a positive tolerance (e. g. from +0.05 to −0.01 mm).

The insulating piece 20 is preferably made of abrasion resistant material such as Teflon of which the longitudinal length is smaller than that of the abovementioned central guiding needle 10; besides, a central bore 21 for insertion connecting the central guiding needle 10 is included therein. In the preferred embodiment as shown in the figures, a lower rod portion 22 of the insulating piece 20 is slightly smaller than the main body of the insulating piece 20, and is connected to the latter via a bevel guiding surface 23; this structure is provided for convenience of its tight connecting to the corresponding inner bore of a metal connector 30.

The metal connector 30 is provided with an inner bore 31 for assembling with the abovementioned insulating piece 20, the main disk body 32 has a threaded section 33 extended downwards therefrom. The main disk body 32 in a round shape is provided on both sides thereof with cut plain surfaces 34, 35 for the convenience of locking the whole connector 30 with a tool. In the preferred embodiment as showing in the figures, an annular portion 36 of a smaller diameter is provided slightly above the main disk body 32, the annular portion 36 forms with the surface of the main disk body 32 a recessed neck portion 37 therebetween. The metal connector 30 of this structure must be processed by an electroplating treatment. For the purpose of having a smaller coefficient of friction, the metal connector 30 is preferably plated with white chrome in order to have a better effect. The inner bore 31 of the metal connector 30 and the insulating piece 20 with the shank portions thereof of different diameters can be connected tightly with each other with set negative and positive tolerances.

Figure 4:
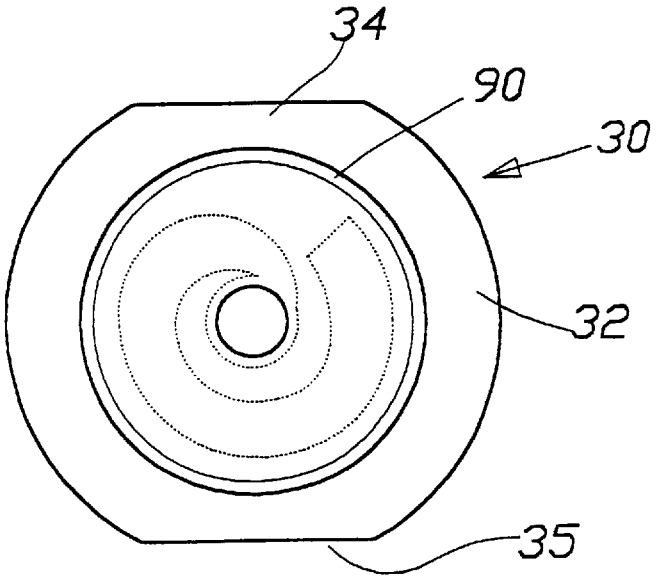
FIG. 4 is a top view of FIG. 3.
Figure 5:
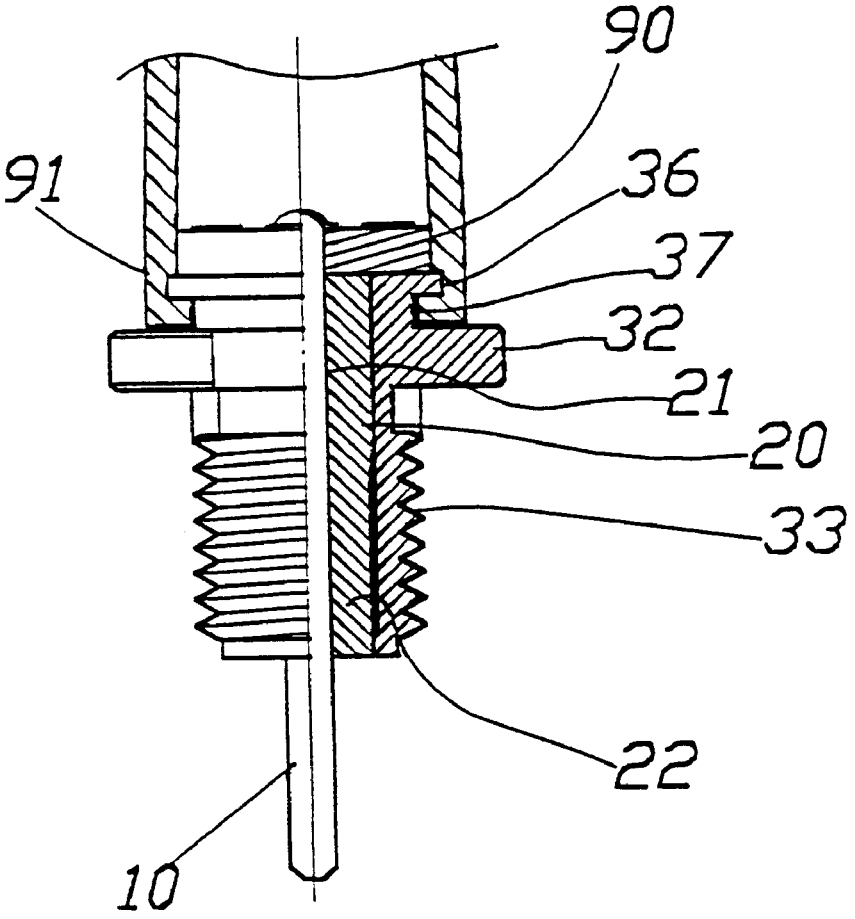
FIG. 5 is a partial sectional schematic view showing the sleeve of FIG. 3 after ejection shaping.

As shown in FIG. 3 and FIG. 4, the central guiding needle 10 can be inserted and installed in the central bore 21 of the insulating piece 20; an electric circuit board 90 is provided on its top, and the lower end of the guiding needle 10 is extended downwardly for a given length. The main body of the antenna under this assembling condition can have the portion above the main disk body 32 connected with a sleeve 91 formed by ejection shaping as shown in FIG. 5. Then they can be assembled together in the inner threaded hole 93 on top of the mobile phone 92 for connecting the antenna (referring to FIG. 6). During this assembling process in a factory, an operator uses a tool or a pair of automatic pliers to clamp the cut plain surfaces 34, 35 of the metal connector 30 and lock the threaded section 33 into the inner threaded hole 93 on the top of the above-mentioned mobile phone, and the portion above the main disk body 32 of the metal connector 30 will be exposed on the top of the mobile phone.

Figure 6:
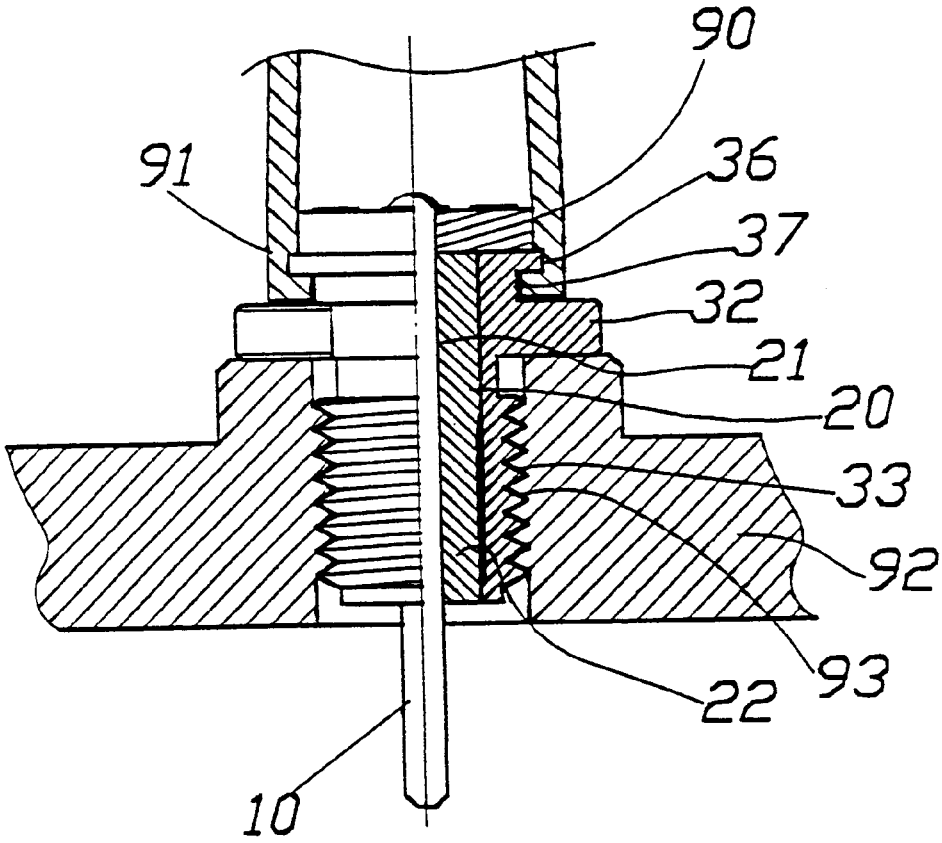
FIG. 6 is a schematic sectional view showing installment of the sleeve of FIG. 5 on a mobile phone.

Referring to FIGS. 5 and 6 at the same time, while the abovementioned antenna main body is under the process of ejection shaping of the sleeve 91, the ejected material will be adhered to the annular portion 36 of a smaller diameter, the periphery of the recessed neck portion 37 and the electric circuit board 90 above the main disk body 32 of the metal connector 30. The material of the electric circuit board 90 will make the ejected plastic material and the electric circuit board 90 connect integrally, however the portion of the metal connector 30 enveloped with the ejected material has been pre-plated with a layer of white chrome and will be in a state of slidable connecting. Thereby when a user rotates the whole antenna with hands after it is locked on the mobile phone in the factory, the sleeve 91 with the electric circuit board 90 and the central guiding needle 10 will rotation idle above the main disk body 32. Thus a user will be unable to detach the whole antenna from the antenna-connecting seat of the mobile phone.

The improvement of the present invention as mentioned above surely can prevent a user from detaching an antenna from a mobile phone at will, because the phenomena of bad signal receiving and function damage due to self-detachment of the antenna can be prevented effectively. The present invention thereby is industrially valuable. Having thus described my invention, what I claim as new and desire to be secured by Letters Patent of the United States are:

What is claimed is:

1. An antenna detaching-proof rotation idling device, said device has a metal connector for locking on an antenna connecting seat of a mobile phone, said metal connector is provided with an inner bore which is electroplated, a threaded section of said metal connector is extended downwardly from a main disk body of said metal connector; an insulating piece is assembled in said inner bore of said metal connector in a tight connecting mode, a central guiding needle is inserted and installed in a central bore provided in said insulating piece in a loose connecting mode; the top end of said central guiding needle is extended to get above said main disk body of said metal connector for assembling and connecting with an electric circuit board, the lower end of said guiding needle is extended downwardly a given length out of said metal connector and said insulating piece in said metal connector; the portion of said metal connector above said main disk body is ejection shaped into a sleeve.

2. An antenna detaching-proof rotation idling device as claimed in claim 1, wherein, An annular portion of a diameter relatively smaller than that of and provided slightly above said main disk body of said metal connector forms a recessed neck portion between said annular portion itself and the surface of said main disk body.

3. An antenna detaching-proof rotation idling device as claimed in claim 1, wherein, two cut plain surfaces on each side respectively are provided on said main disk body of said metal connector to be clamped with a pair of pliers.

4. An antenna detaching-proof rotation idling device as claimed in claim 1, wherein, said metal connector is plated with a layer of white chrome.

5. An antenna detaching-proof rotation idling device as claimed in claim 1, wherein, said insulating piece is made of Teflon to have a given length and to include an upper rod portion and a lower rod portion of different diameters and a bevel-guiding surface connecting said upper and lower rod portions.

6. An antenna detaching-proof rotation idling device as claimed in claim 2, wherein, said metal connector is plated with a layer of white chrome.

7. An antenna detaching-proof rotation idling device as claimed in claim 3, wherein, said metal connector is plated with a layer of white chrome.

* * * * *